US006334593B2

(12) United States Patent
Inoue

(10) Patent No.: US 6,334,593 B2
(45) Date of Patent: Jan. 1, 2002

(54) BAG HOLDER

(75) Inventor: Seiji Inoue, Matsuyama (JP)

(73) Assignee: Aramu Kabushiki Kaisha, Osaka (JP)

( * ) Notice: Subject to any disclaimer, the term of this patent is extended or adjusted under 35 U.S.C. 154(b) by 0 days.

(21) Appl. No.: 09/239,821

(22) Filed: Jan. 29, 1999

(30) Foreign Application Priority Data

Feb. 2, 1998 (JP) ..... 10-021314

(51) Int. Cl.[7] ..... B65B 67/12
(52) U.S. Cl. ..... 248/95; 248/98; 248/99
(58) Field of Search ..... 248/98, 99, 95, 248/97, 100, 101, 164, 172, 173, 170, 436

(56) References Cited

U.S. PATENT DOCUMENTS 206,855 A * 8/1878 Bissell et al. ..... 248/98
289,181 A * 11/1883 Valentine ..... 248/99
385,411 A * 7/1888 Fuller ..... 211/85.17
748,387 A * 12/1903 Lilly ..... 248/97
1,477,233 A * 12/1923 Alexander ..... 108/14
2,845,317 A * 7/1958 Orman ..... 248/164
3,286,752 A * 11/1966 Duryee, Jr. ..... 220/9.3
3,502,291 A * 3/1970 Ackerman et al. ..... 248/97
3,633,932 A * 1/1972 Holden ..... 280/641
3,655,157 A * 4/1972 Dalton ..... 248/97
3,659,816 A * 5/1972 Wilson ..... 248/97
3,893,648 A * 7/1975 Gilbert ..... 248/97
4,281,814 A * 8/1981 Verwey ..... 248/97
4,304,378 A * 12/1981 Briggs ..... 248/97
4,549,748 A * 10/1985 Haley, Sr. ..... 280/641
4,613,104 A * 9/1986 Garrott ..... 248/97
4,620,683 A * 11/1986 Claydon et al. ..... 248/97
4,646,802 A * 3/1987 Basore et al. ..... 220/9.4
4,664,455 A * 5/1987 Greenhow ..... 312/211
4,692,050 A * 9/1987 Kaufman ..... 403/3
4,723,741 A * 2/1988 Doering ..... 248/97
4,763,865 A * 8/1988 Danner ..... 248/164
4,822,178 A * 4/1989 Taylor ..... 383/33
4,917,393 A * 4/1990 Rogers ..... 280/47.28
4,953,815 A * 9/1990 Beymer et al. ..... 248/97
5,857,649 A * 1/1999 Eason ..... 248/164

* cited by examiner

*Primary Examiner*—Leslie A. Braun
*Assistant Examiner*—Naschica Morrison
(74) *Attorney, Agent, or Firm*—Armstrong, Westerman, Hattori, McLeland & Naughton, LLP

(57) ABSTRACT

A bag holder for suspending a bag thereat with an opening portion of the bag directed upward, comprising a pair of arm members respectively provided with holding members for engaging and holding an opening edge portion of the bag, a pair of crossing means that intersect with each other being extended downward from end portions of the arm members and making the pair of arm members freely open/close around a fulcrum portion, and a pair of grounding members being extended from lower ends of the pair of crossing members as to oppose the pair of arm members. Attaching/detaching of the bag can be easily performed since the bag might simply be hung against or detached from a pair of holding means. Further, since bags can be held in a suspend manner, the external appearance thereof can be made attractive and cleaning of the floor can be easily performed.

11 Claims, 19 Drawing Sheets

BAG HOLDER

BACKGROUND OF THE INVENTION

The present invention relates to a bag holder. More particularly, it relates to a bag holder with which trash bags used at home or event halls or plugging bags for industrially used powder or grain can be easily held in a freely attachable/detachable manner.

There are known conventional methods for installing, for instance, a trash bag at a specified place, examples of which might be a mechanical chucking arrangement in which the trash bag is accumulated into an outer cylinder, an inner ring is fitted to an edge portion of the trash bag opening and the inner ring is chucked as to close the bag, or a floor fixing type in which the trash bag is accumulated into a trash container and is covered by a lid thereafter.

However, in the arrangement in which the bag is mechanically chucked, the complicated arrangement of the chuck makes the attaching/detaching of the trash bag troublesome and taking out of the trash bag after use inconvenient. Further, a drawback is presented in case the size of the trash bag is small or large, since they cannot be used because their opening size do not fit.

On the other hand, those of the floor fixing type present a drawback that they do not look attractive and need to be moved in case the floor is to be cleaned.

The present invention has been made in view of these circumstances, and it is an object thereof to present a bag holder which enables easy operation of attaching/detaching the bags, which can be generally used, and which external appearance is attractive.

SUMMARY OF THE INVENTION

In accordance with a first aspect of the present invention, there is provided a bag holder for suspending a bag thereat with an opening portion of the bag directed upward, comprising a pair of arm members respectively provided with holding means for engaging and holding an opening edge portion of the bag, a pair crossing members that intersect with each other being extended downward from end portions of the arm members and make the pair of arm members freely open/close around a fulcrum portion, and a pair of grounding members being extended from lower ends of the pair of crossing members as to oppose the pair of arm members.

In accordance with a second aspect of the present invention, there is provided a bag holder for suspending a bag thereat with an opening portion of the bag directed upward, comprising a pair or arm members respectively provided with holding means for engaging and holding an opening edge portion of the bag, a pair of crossing members that intersect with each other being extended downward from end portions of the arm members and make the pair of arm members freely open/close around a fulcrum portion, an erecting member for supporting the fulcrum portion, a grounding member fixedly attached at a lower end of the erecting member, and a pair of springs engaged at the crossing members and the erecting member at both lateral positions of the fulcrum portion.

In accordance with a third aspect of the present invention, there is provided a bag holder for suspending a bag thereat with an opening portion of the bag directed upward, comprising a pair or arm members respectively provided with holding means for engaging and holding an opening edge portion of the bag, two pairs of crossing members that intersect with each other being extended downward from both end portions of the arm members and make the pairs of arm members freely open/close around a pair of fulcrum portions, and rotating members attached to lower ends of the pair of crossing members.

In accordance with a fourth aspect of the present invention, there is provided a bag holder for suspending a bag thereat with an opening portion of the bag directed upward, comprising a pair or arm members respectively provided with holding means for engaging and holding an opening edge portion of the bag, a pair of crossing members that intersect with each other being extended downward from end portions of the arm members and make the pair of arm members freely open/close around a fulcrum portion, an erecting member for supporting the fulcrum portion, an attaching member fixedly attached to a lower end of the erecting member in a horizontal direction, a pinching member screwed at the attaching member, and a pair of springs engaged at the crossing members and the erecting member at both lateral positions of the fulcrum portion.

DETAILED DESCRIPTION

The bag holder of the present invention will now be explained based on the accompanying drawings.

Figure 1:
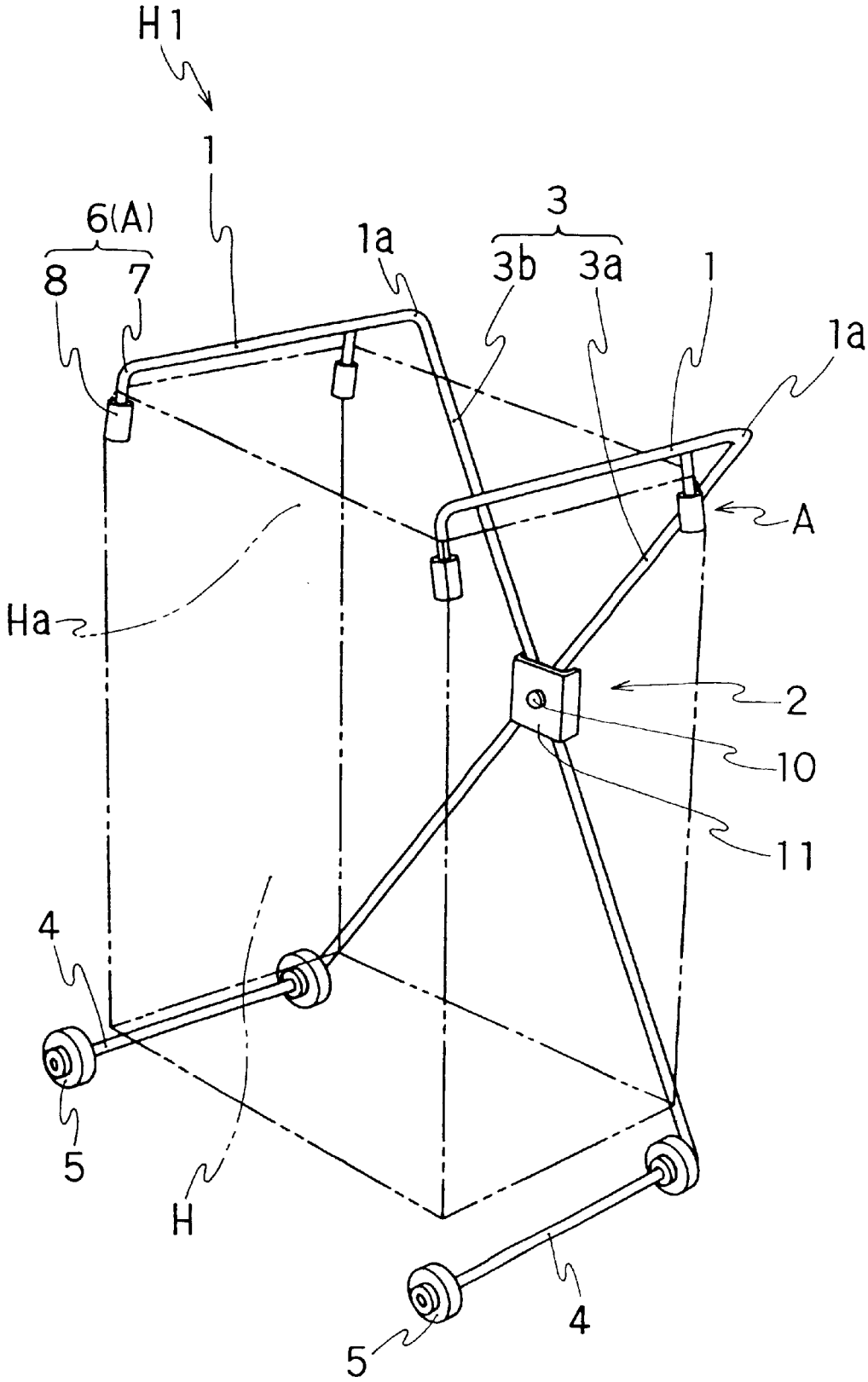
FIG. 1 is a view showing a bag holder in a condition for use according to one embodiment of the present invention.
Figure 2:
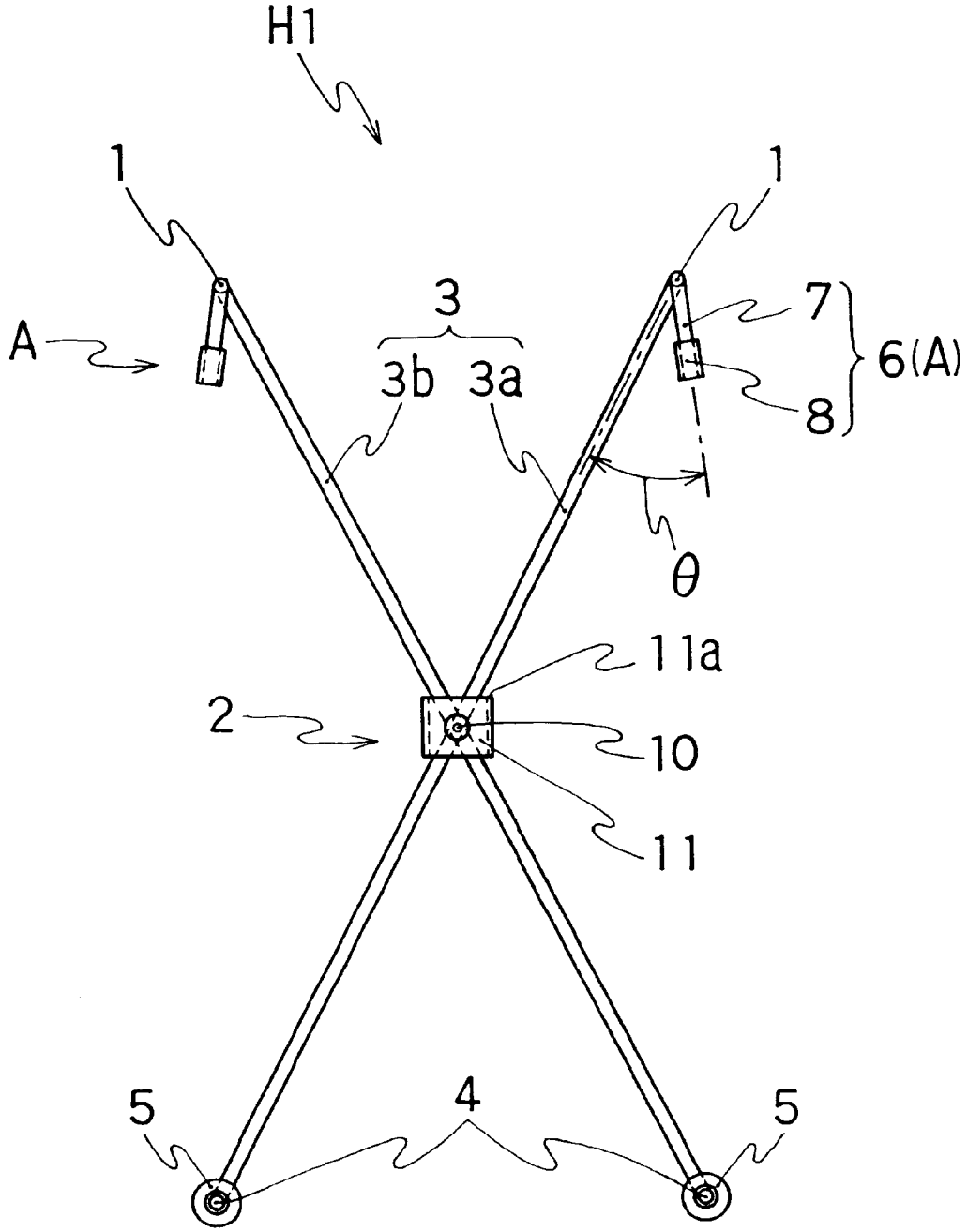
FIG. 2 is a front view of the bag holder of FIG. 1.
Figure 3:
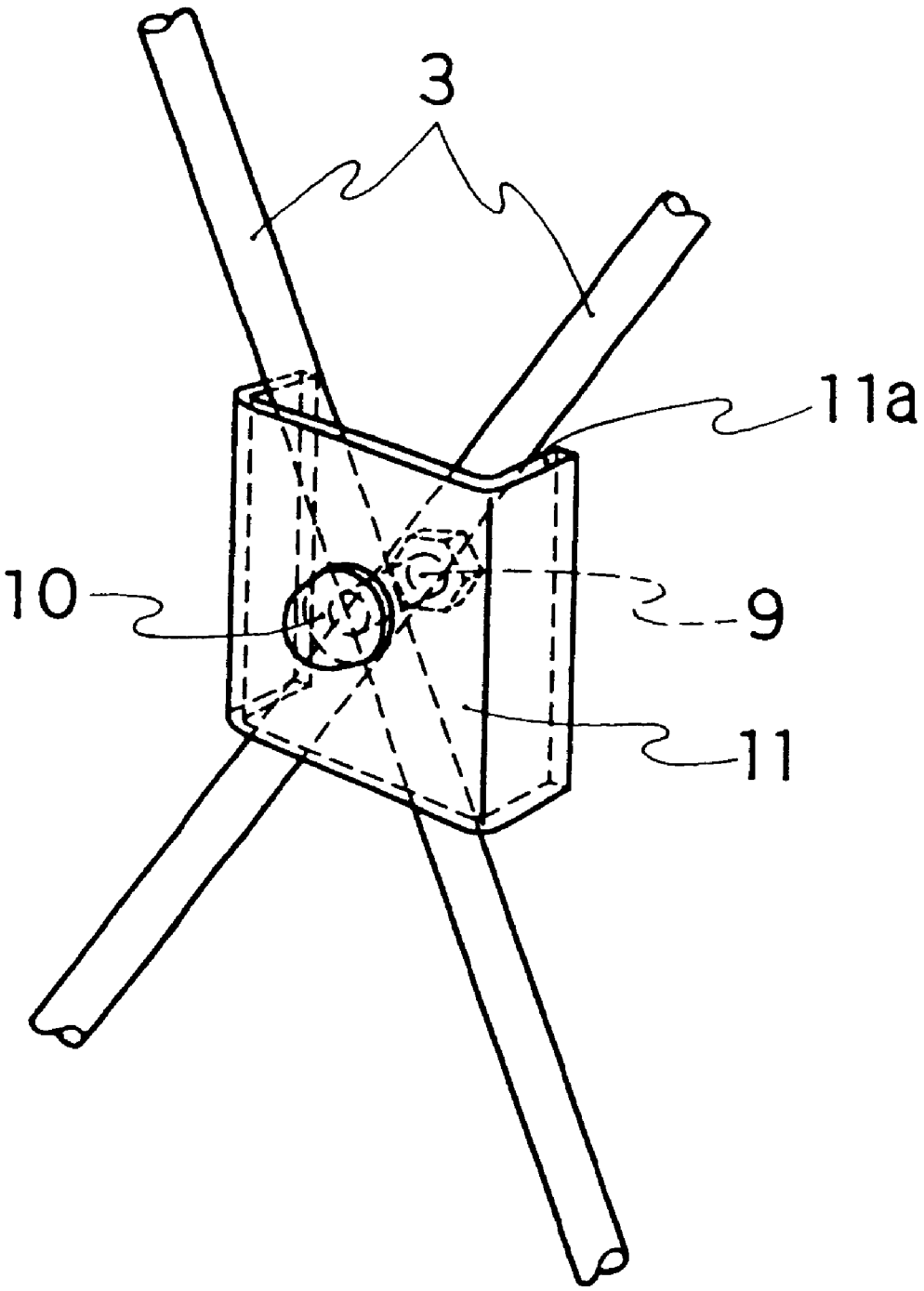
FIG. 3 is a partially enlarged view showing a fulcrum portion of the bag holder of FIG. 1.

As shown in FIGS. 1 to 3, a bag holder H1 according to an embodiment of the present invention is composed of a pair of arm members 1 at which there are respectively formed a holding means A, a pair of crossing members 3 consisting of a first crossing member 3*a* and a second crossing member 3*b* that intersect with each other being extended from end portions la of the arm members 1 and making the pair of arm members 1 freely open/close around a fulcrum portion 2, a pair of grounding members 4 being extended from lower ends of the pair of crossing members 3 as to oppose the pair of arm members 1, and rotating members such as rollers 5 or casters attached to the grounding members 4.

Figure 4:
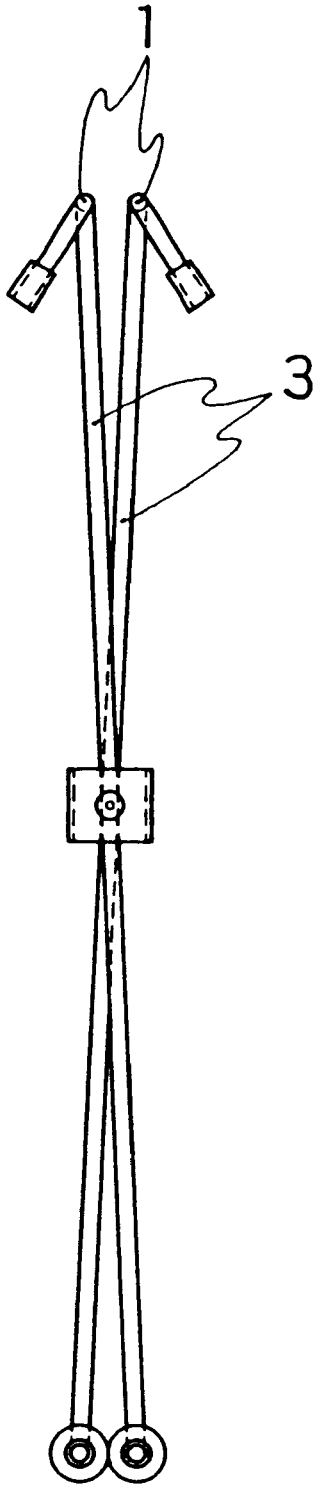
FIG. 4 is a front view showing a folded condition of the bag holder of FIG. 1.

The bag holder H1 of the present embodiment is so arranged that the bag H can be suspended with its opening portion facing upward and its bottom surface being lifted from the floor by making an opening edge portion Ha of the bag H engage at the holding means A from a lower side of the pair of arm members 1 and held thereat. The rotating members such as the rollers 5 make it easier for the space between the pair of grounding members 4 to expand as contents in the bag H increase so that, consequently, the space between the pair of arm members 1 expands to increase the holding force provided by the holding means A. When the bag holder H1 is not used, the pair of arm members 1 can be closed so that the pair of crossing members 3 are overlapped to assume a stick-like appearance as shown in FIG. 4, and the accumulating space for the bag holder can be made small. It should be noted that bags of polyethylene, vinyl chloride resin, hemp, paper and the like can be appropriately used as the bag H.

The holding means A might be a pair of holding members 6 that are provided at positions on the arm members 1 being remote from each other by a specified distance. The holding members 6 are set as to make an angle θ between the crossing members 3 to be approximately 20 to 50° and are directed outwardly as shown in FIG. 2. The holding members 6 are preferably composed of a base portion 7 extending from the arm members 1 and an engaging member 8 of cylindrical shape provided at an end portion of the base portion 7, respectively, whereby the opening edge portion Ha of the bag H cuts into uneven portions formed at a bordering portions between the base portions 7 and the engaging members 8 so that the bag H can be easily held.

It should be noted that while the shape of the engaging members is cylindrical in this embodiment, the present invention is not limited to this shape as long as uneven portions are formed between the base portions and the engaging members, and they might, for instance, be of spherical or polygonal shape. While rubber, synthetic resin or wood can be employed as a material for the engaging members, it is preferable to employ rubber, especially silicone rubber, since they exhibit large friction coefficients and their surfaces are hard to slip. In order to further improve skid-proof effects, it is preferable to adhere rubber or the like to the surface of the engaging members 8 or to perform any skid-proof means such as scratch-brush finishing or emboss finishing.

Further, while rollers are respectively attached to the pair of grounding members in this embodiment, the present invention is not limited to this, and the roller might also be arranged, for instance, at one grounding member of the pair of grounding members. Alternatively, in case the floor is slippery, the rollers might also be omitted.

It should be noted that the opening edge portion Ha might be torn in case the pair of grounding members 4 is excessively expanded. For this reason, in order to prevent expansion of the pair of grounding members 4 to exceed a specified range for usage so as not to exceed a range of usage of the bag provided between the pair of arm members, it is preferable to attach a stopper 11 having a substantially U-shaped section at a pin 10 inserted into a fulcrum hole 9 formed at the pair of crossing members 3 at the fulcrum portion 2. This stopper 11 might, for instance, be attached by a screw portion and nut of the pin 10. By attaching such a stopper 11, the pair of crossing members 3 contact an edge portion 11*a* of the stopper 11 when the contents of the bag H become heavy whereby the opening degree of the crossing members 3 is limited to a specified opening degree, and the expansion of the pair of grounding members 4 can be prevented accordingly. It should be noted that the stopper might alternatively be replaced by a stopping member such as a rope or chain stretched between the pair of crossing members.

Figure 5:
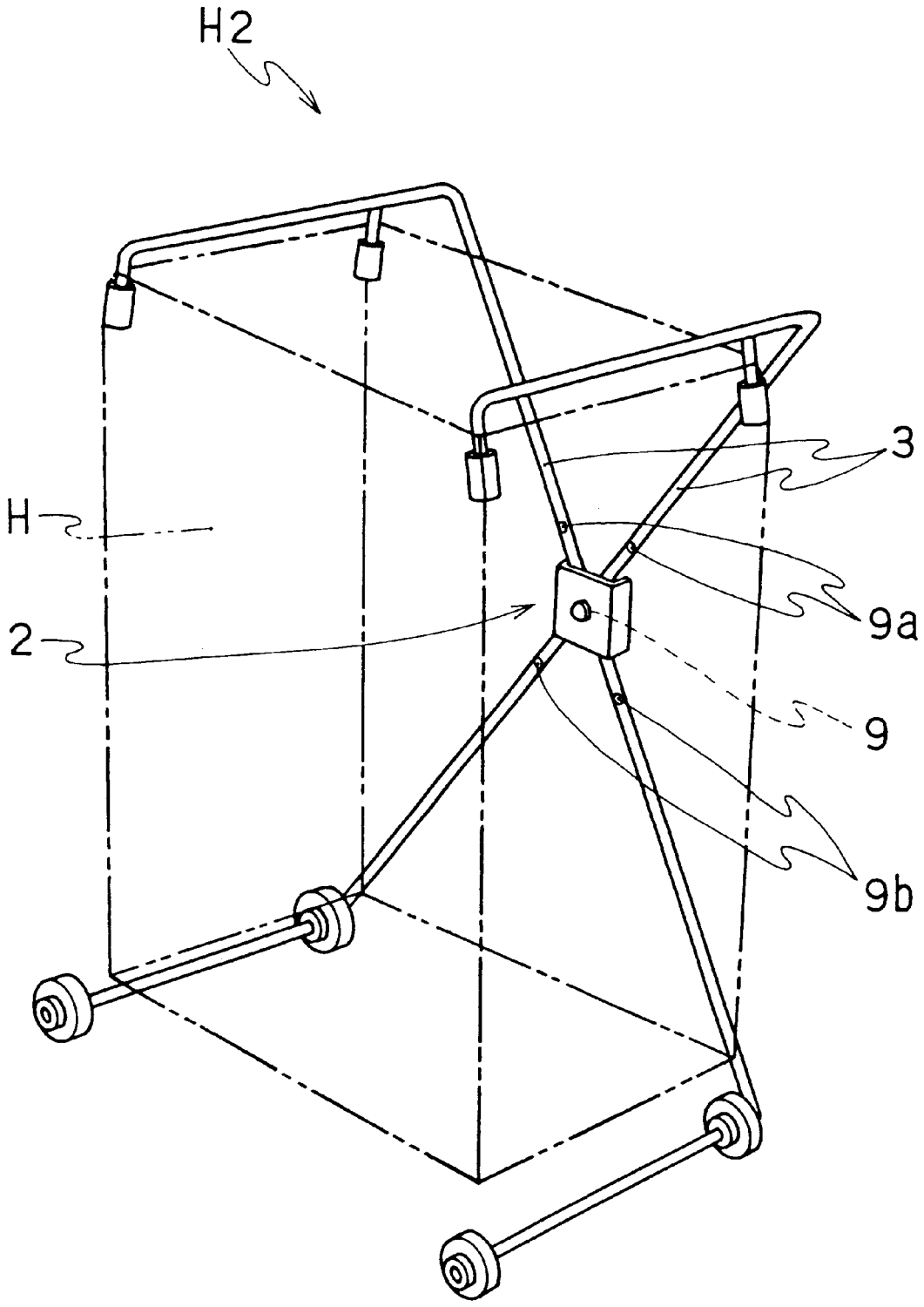
FIG. 5 is a view showing a bag holder in a condition for use according to another embodiment of the present invention.
Figure 6:
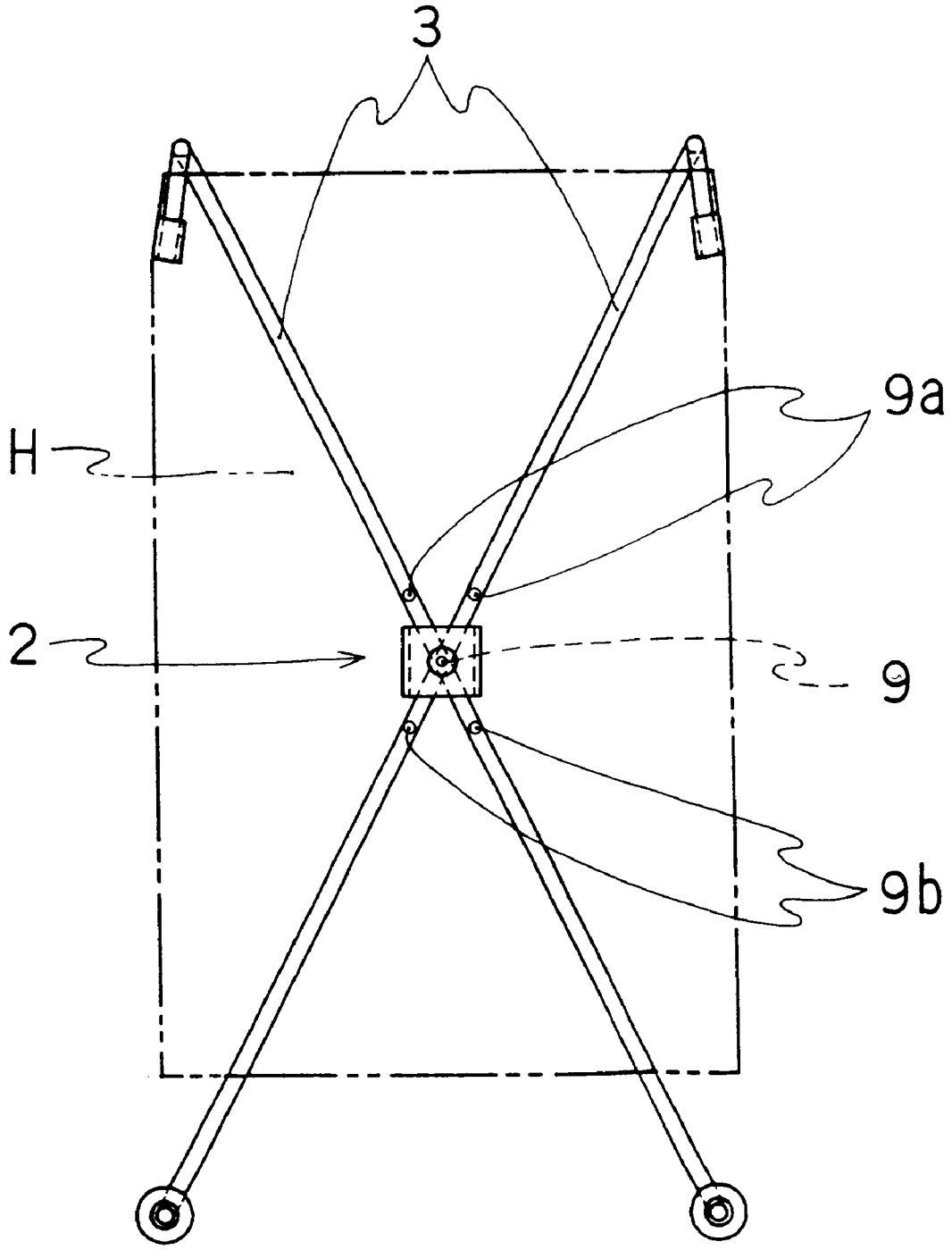
FIG. 6 is a front view of the bag holder of FIG. 5.
Figure 7:
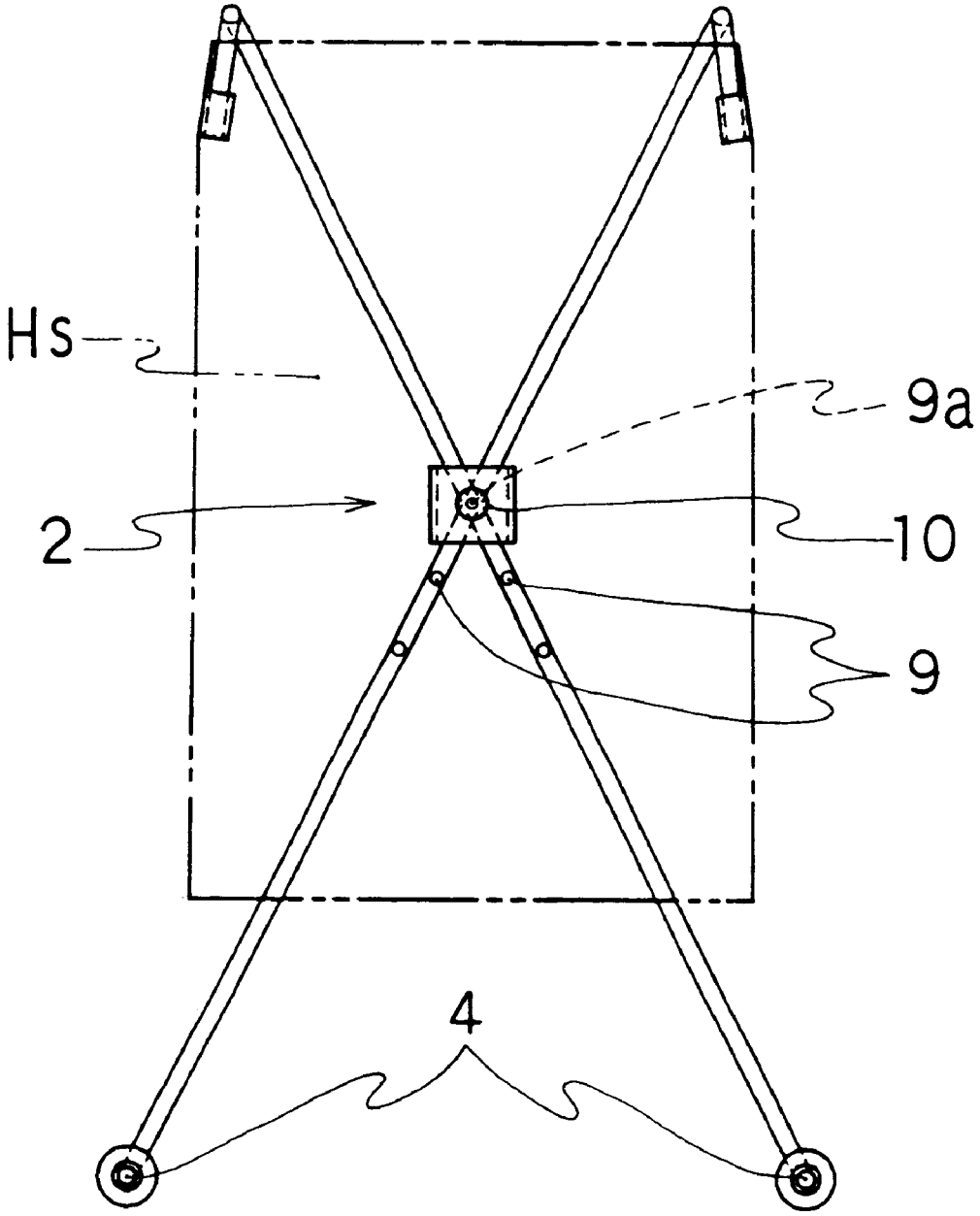
FIG. 7 is a front view showing the bag holder of FIG. 5 in another condition for use.
Figure 8:
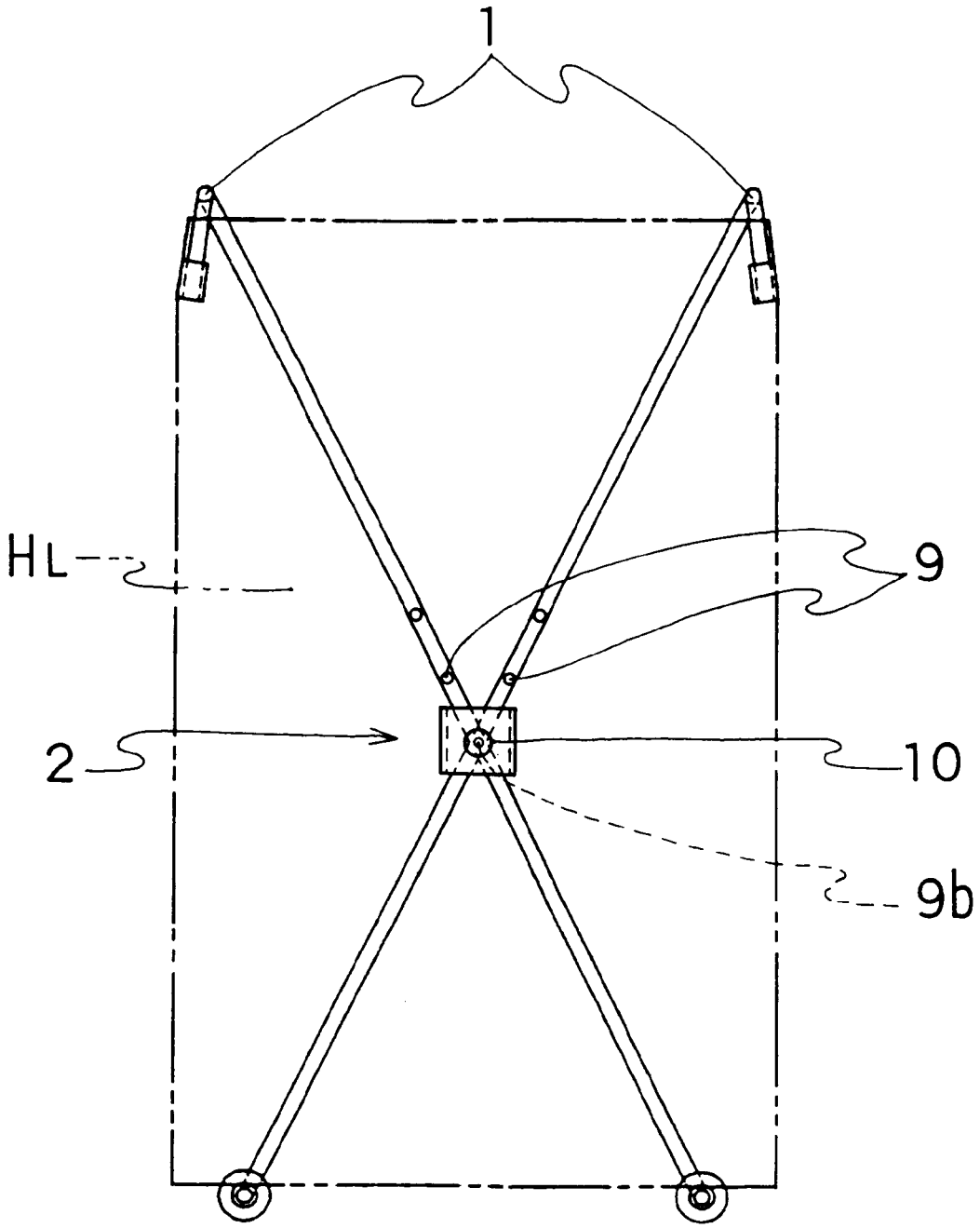
FIG. 8 is a front view showing the bag holder of FIG. 5 in another condition for use.

Another embodiment H2 of the present invention will now be explained. In this embodiment, fulcrum holes 9*a*, 9*b* are additionally formed at upper and lower portions of the fulcrum hole 9 of the pair of crossing members 3 as shown in FIGS. 5 and 6, so that the fulcrum portion 2 at the pair of crossing members 3 can be varied between three positions so as to respectively correspond to a variety of sizes of the bag, e.g. a bag of standard size, a bag having a smaller opening portion than that of the standard size, and a bag having a larger opening portion than that of the standard size. When the fulcrum portion 2 is fixed at the fulcrum hole 9, a bag H of standard size can be held. In case a bag $H_S$ is to be held, the pin 10 is removed from the central fulcrum hole 9 and is inserted into upper fulcrum hole 9*a* as shown in FIG. 7, and the position of the fulcrum portion 2 is changed to an upper position. With this arrangement, the distance between the fulcrum portion 2 and the pair of grounding members 4 is made larger and the pair of crossing members 3 can be sufficiently widened. Accordingly, the bag holder can be moved while holding the small bag $H_S$ in a stable condition. In case a large bag $H_L$ is to be held, the pin 10 is removed from the central fulcrum hole 9 and is inserted into a lower fulcrum hole 9*b* as shown in FIG. 8, and the position of the fulcrum portion 2 is changed to an lower position. With this arrangement, the pair of arm members 1 can be lifted to a high position. Accordingly, contents can be filled up to a periphery of the bottom portion of the bag $H_L$ without the bottom portion grounding on the floor surface, and the bag holder can be moved while contents are contained therein.

Figure 9:
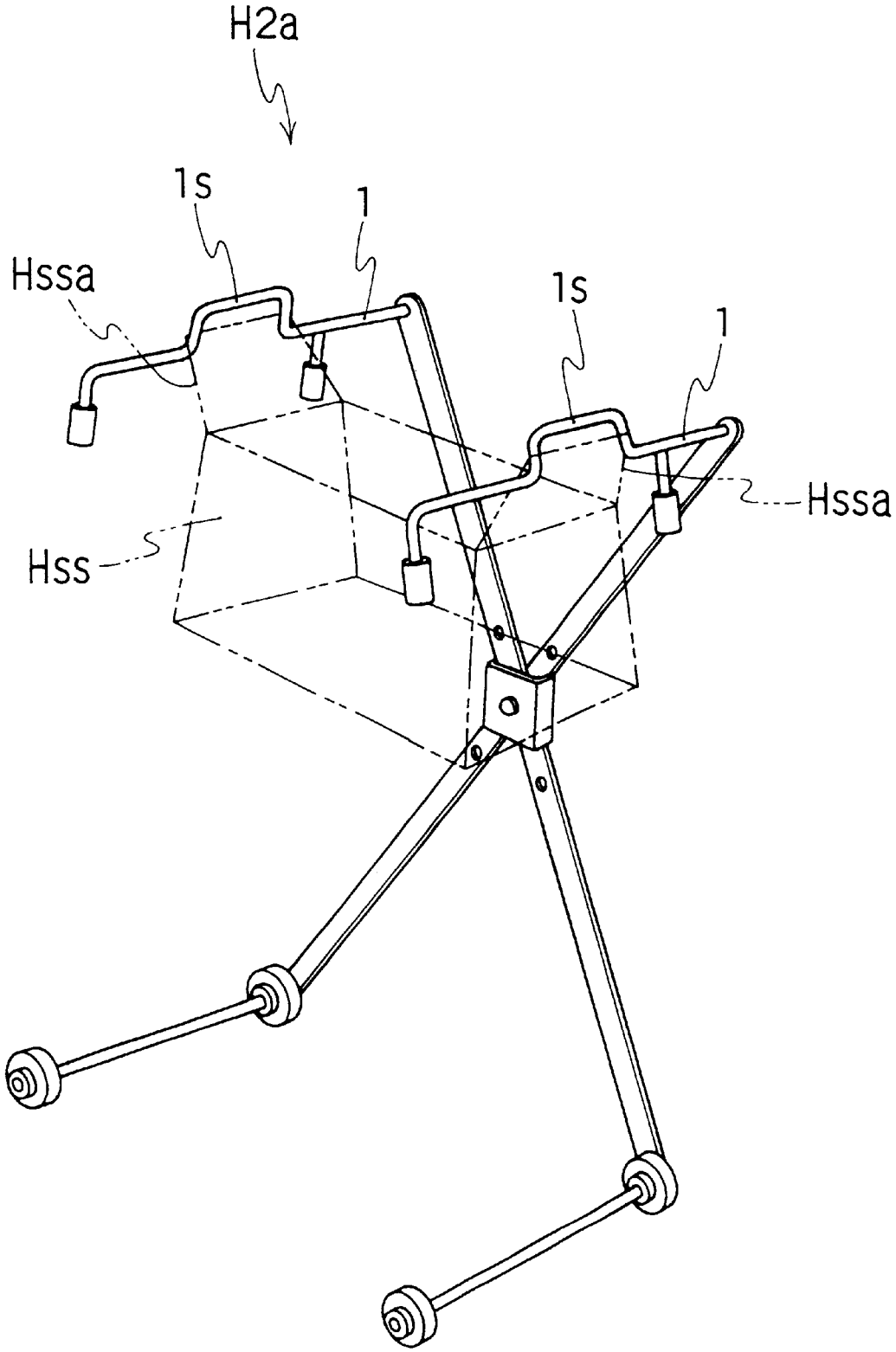
FIG. 9 is a view showing a bag holder in a condition for use according to still another embodiment of the present invention.
Figure 10:
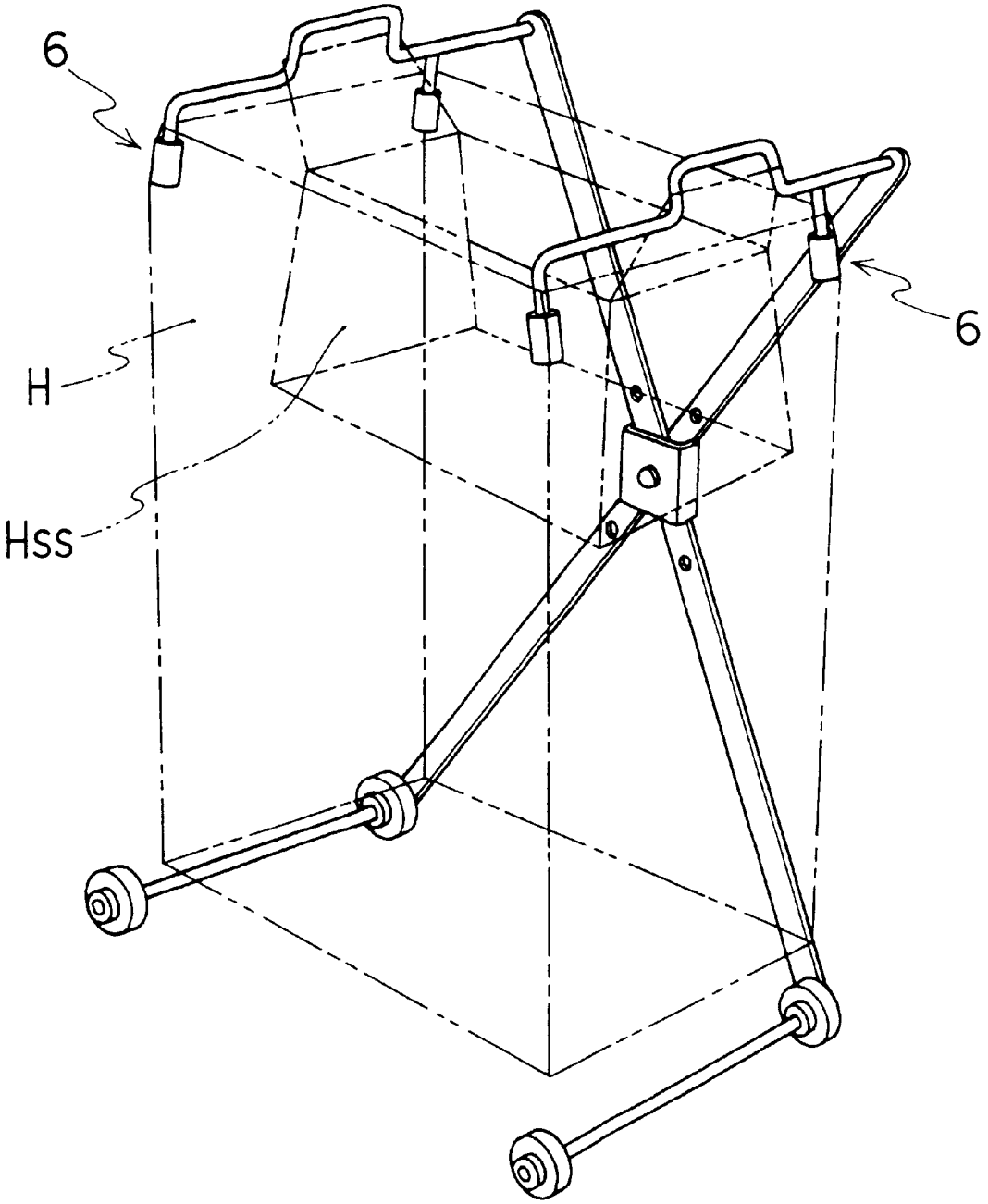
FIG. 10 is a view showing the bag holder of FIG. 9 in another condition for use.

Next, still another embodiment of the present invention will be explained. A bag holder H2*a* according to this embodiment is provided, as shown in FIG. 9, with hanging portions is so that grasping portions $H_{ssa}$ of a small handy bag $H_{ss}$ as can be obtained in supermarkets or the like can be hung thereat. Shapes of such hanging portions is are not particularly limited in the present invention, and they might be formed by bending a part of the arm members into a substantially U-shaped form. The bag holder H2*a* according to this embodiment is suitably used, for instance, in household wherein kitchen garbage is filled into bag $H_{ss}$, and in case it is full, its opening edge portion is tied to be inserted into a larger bag. As shown in FIG. 10, the bag holder H2*a* according to this embodiment can be used in a double manner wherein a bag H is held by the holding members 6 and a small bag $H_{ss}$ is held by the hanging portions 1*s*, so that it is possible to put kitchen garbage into the small bag $H_{ss}$ and other trash into the larger bag H. In case the small bag $H_{ss}$ is full, it can be directly thrown into the larger bag H. With this arrangement, the floor will not become dirty by the kitchen garbage and the space for the trash bags can be minimized.

Figure 11:
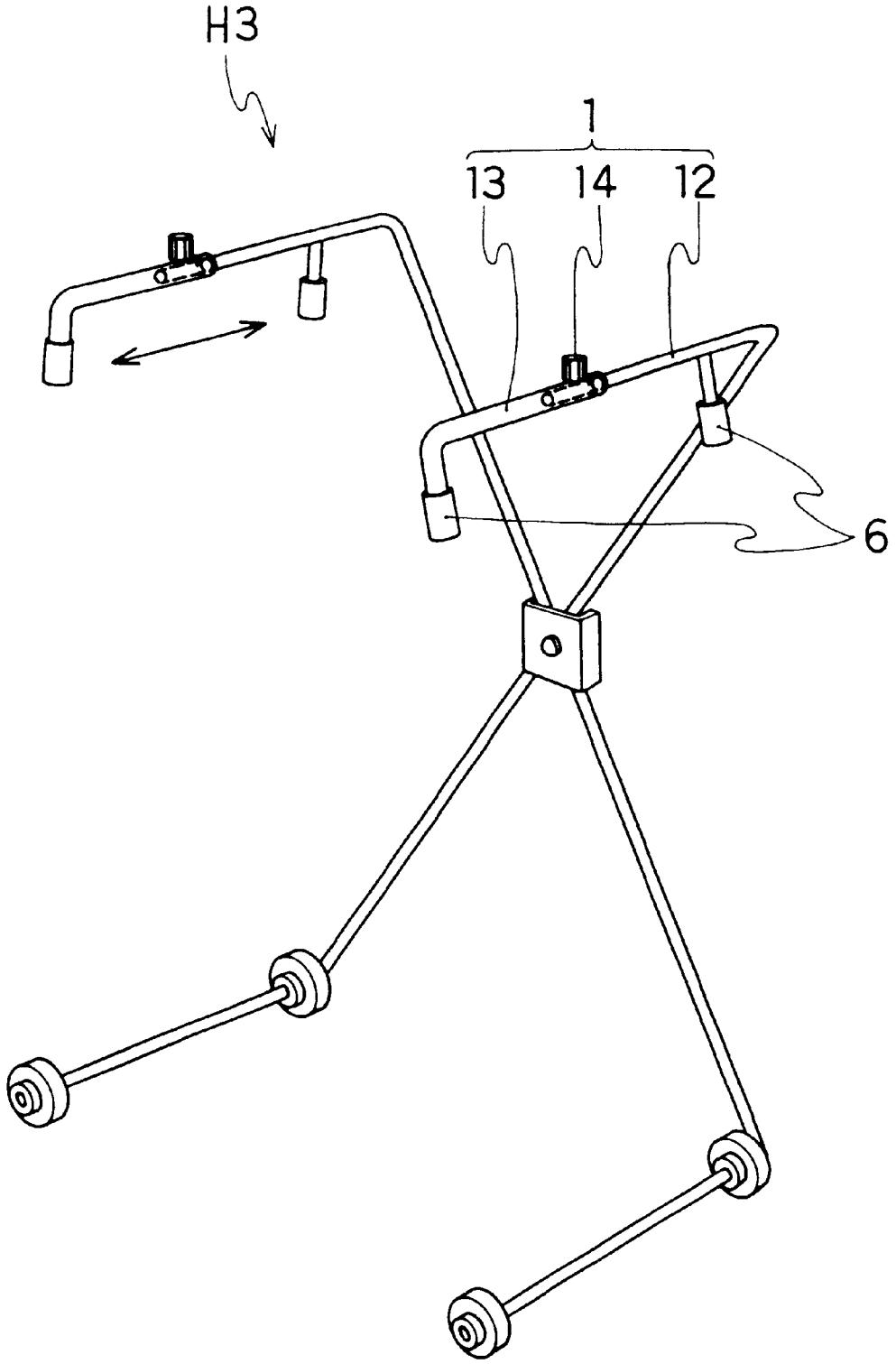
FIG. 11 is a view showing a bag holder in a condition for use according to still another embodiment of the present invention.

Another embodiment of the present invention will now be explained. In this embodiment, portions of the arm members 1 between the pair of holding members 6 are respectively arranged by an arm base member 12, an arm front end member 13 being cylindrical and telescopic with respect to the arm base member 12, and a fixing means for positioning the arm front end member 13, as shown in FIG. 11. The fixing means might, for instance, be bolted knobs 14 for fixing the arm front end members 13 by screwing into screw holes formed at the arm front end portions 13. A bag holder H3 according to this embodiment is arranged such that the space between the pair of holding members 6 can be adjusted by untying the knobs 14 and moving the arm front end members 13 as to suit the size of the opening of the bag, so that it can hold from a small bag to a large bag. Further, since the opening of the bag is held in a substantially rectangular manner, plugging into the bag is made easy. While the arm front end members are arranged to be telescopic in this embodiment, the present embodiment is not limited to this, and it is also possible to arrange the arm front end member to be telescopic by forming the arm base members extending from the crossing members in a cylindrical shape and by inserting the arm front end members into the arm base members. In such a case, screw holes are formed at the arm base members so that the knobs are screwed thereat.

Figure 12:
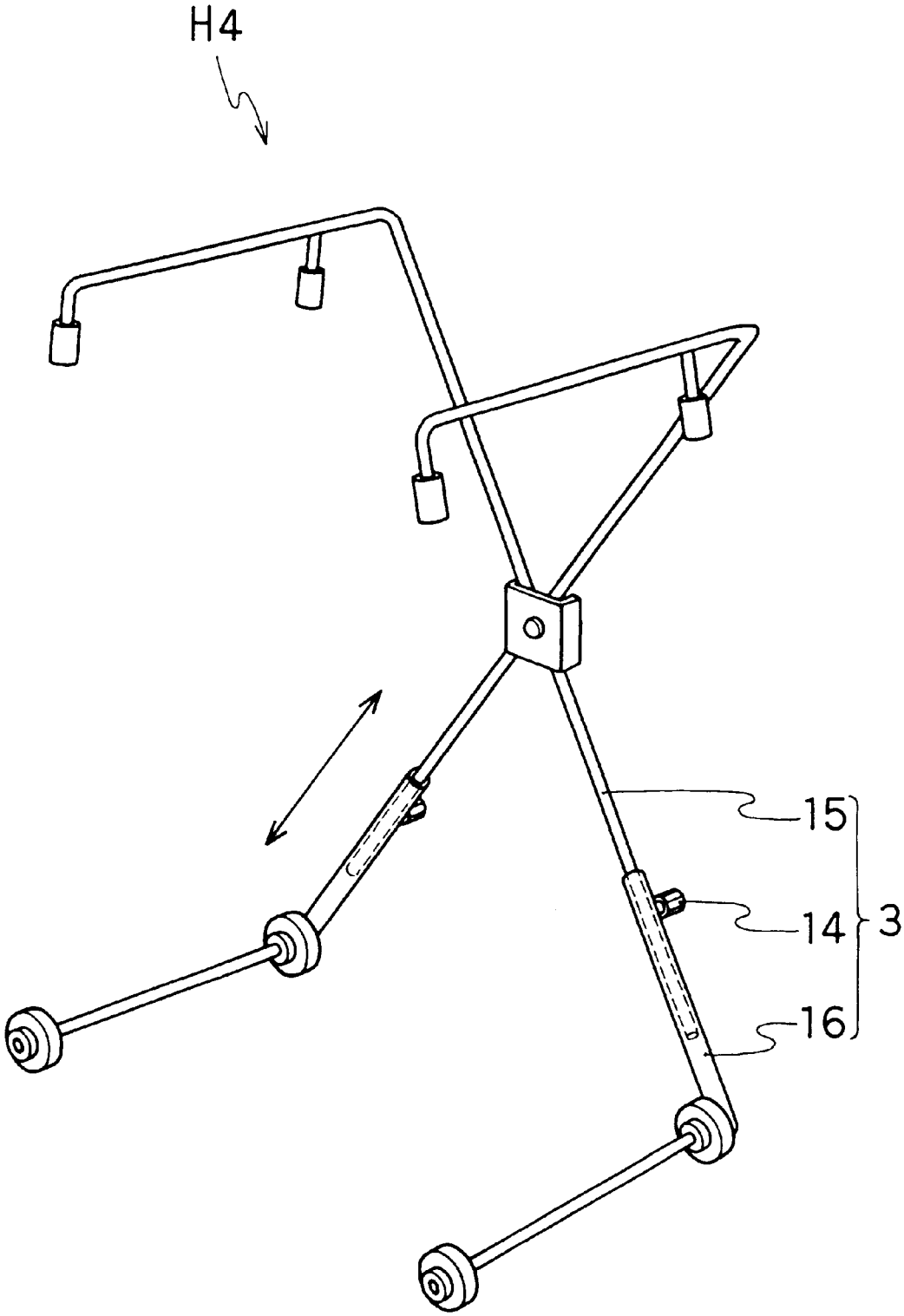
FIG. 12 is a view showing a bag holder in a condition for use according to still another embodiment of the present invention.

Next, still another embodiment of the present invention will be explained. In this embodiment, the pair of crossing members is made to be telescopic so that bags of various sizes can be held. That is, as shown in FIG. 12, the pair of crossing members 3 of the bag holder H4 are respectively composed of a crossing base member 15, a crossing lower end member 16 being cylindrical and telescopic with respect to the crossing base member 15, and a fixing means for positioning the crossing lower end member 16. The fixing means can, for instance, be bolted knobs 14, similarly to the preceding embodiment. It should be noted that while the crossing lower end members are cylindrical in this embodiment, the present invention is not limited to this, and the crossing base members might alternatively be arranged to be cylindrical so that the crossing lower end members can be inserted therein.

Figure 13:
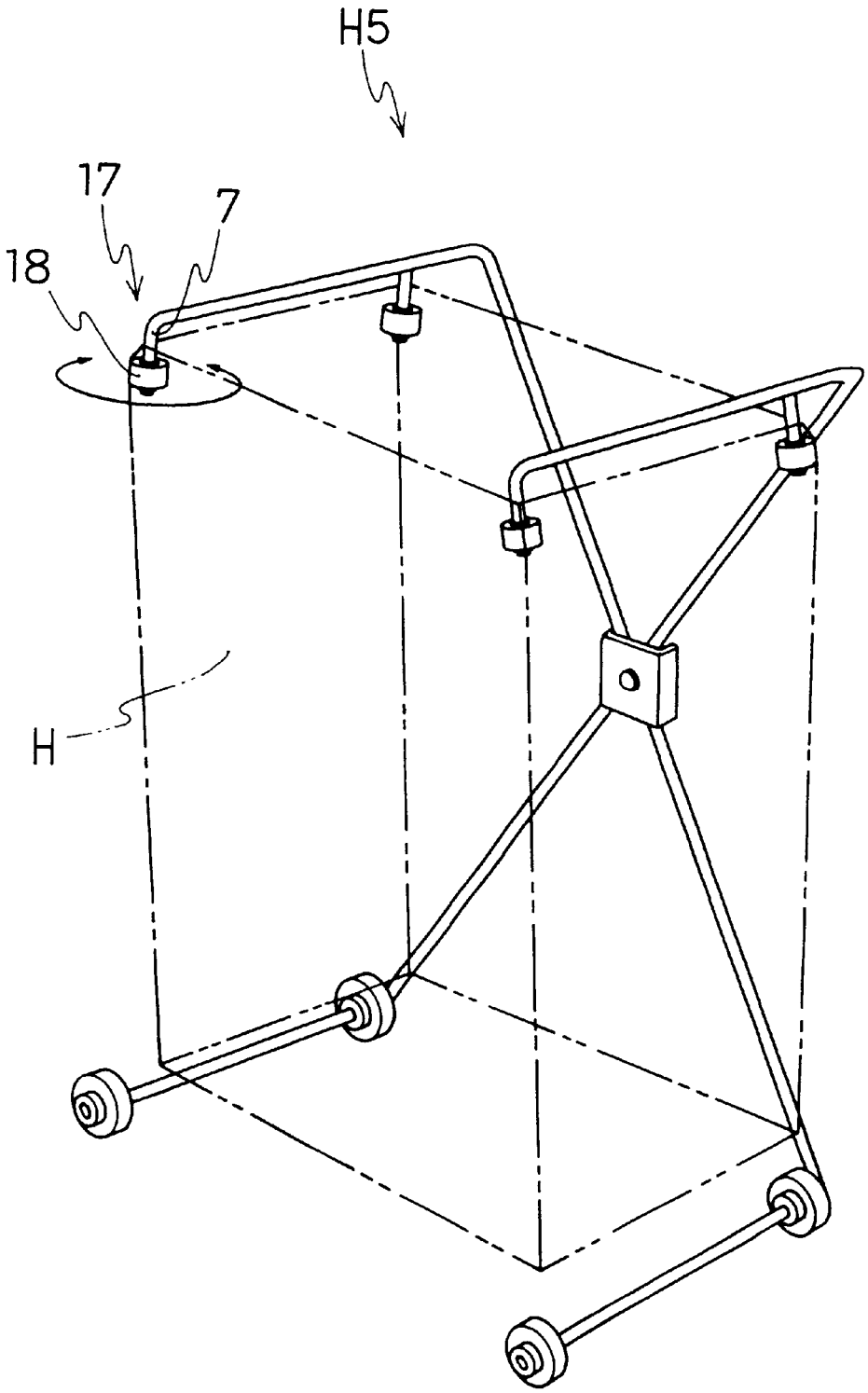
FIG. 13 is a view showing a bag holder in a condition for use according to still another embodiment of the present invention.

Another embodiment of the present invention will now be explained. In a bag holder H5 according to this embodiment, the engaging members of the holding members 17 are made to be rotating rolls 18 rotatable around the base portions 7 as shown in FIG. 13. These rotating rolls 18 make it possible to rotate the bag H while it is remained in an attached condition after the bag H has been held by the holding members 17 so that the position or deformation of the bag H after attaching can be corrected. Further, the rotating rolls 18 might, for instance, be manufactured of silicone rubber, similarly to the preceding embodiment, in order to increase the coefficient of friction. Alternatively, rubber might be adhered to the surface, or skid-proof treatment such as scratch-brush finishing might be performed.

Figure 14:
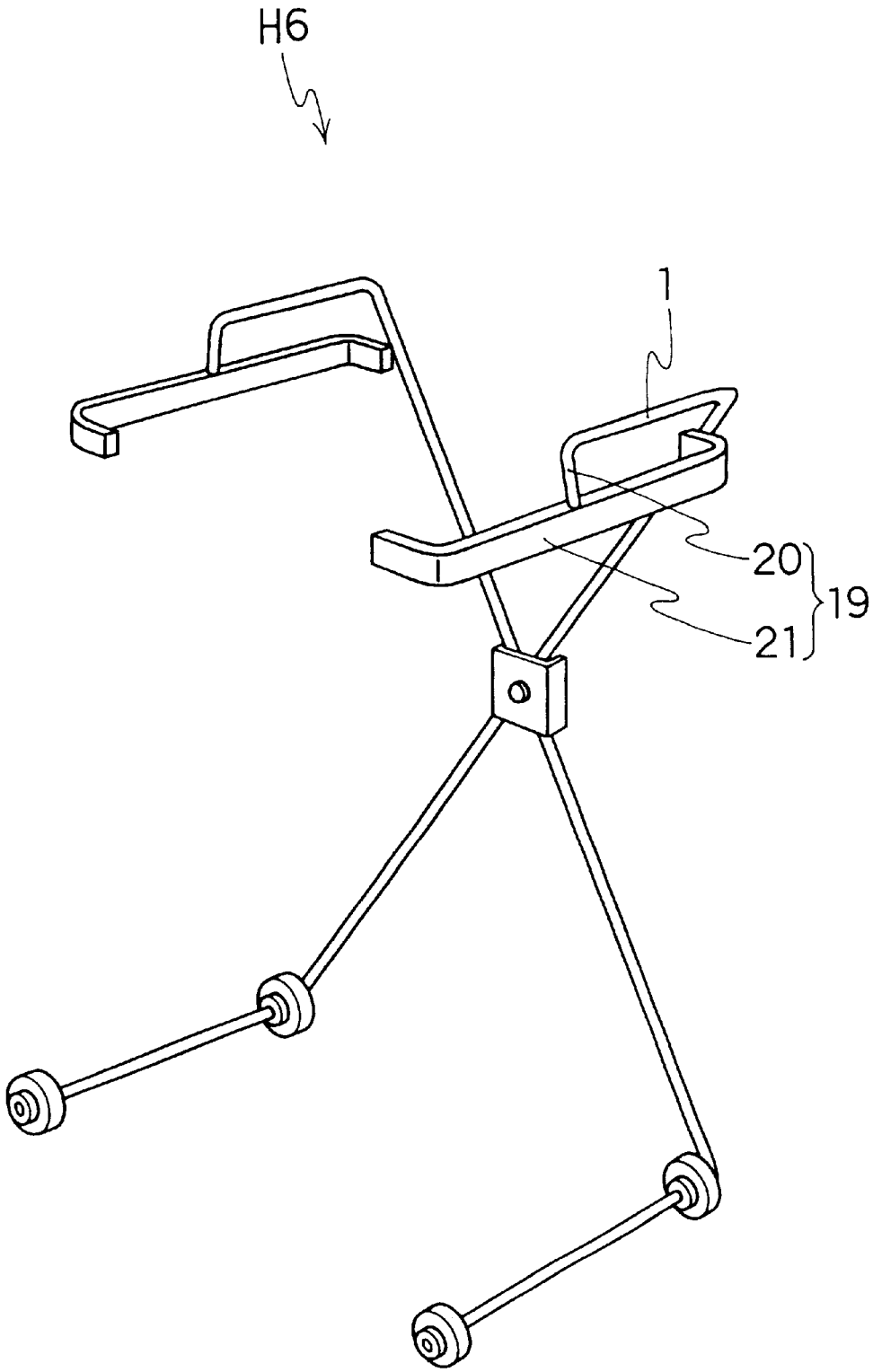
FIG. 14 is a view showing a bag holder in a condition for use according to still another embodiment of the present invention.

Next, still another embodiment of the present invention will be explained. In a bag holder H6 according to this embodiment, the holding members 19 are respectively arranged of a base portion 20 extending from the arm member 1 and a linear engaging portion 21 arranged to be in a substantially horizontal direction of the base portion 20, as shown in FIG. 14. Both ends of the engaging members 21 are bend so as not to damage the bag. The engaging members 21 might, for instance, be manufactured of silicone rubber, similarly to the preceding embodiment, in order to increase the coefficient of friction. Alternatively, rubber might be adhered to the surface, or skid-proof treatment such as scratch-brush finishing might be performed.

Another embodiment of the present invention will now be explained. In the preceding embodiments, in case the pair of grounding members do not have any rotating members such as rollers, the grounding members are hard to expand when the floor is not slippery, and the bearable weight of contents of the bag that is provided by the friction of the engaging members for holding the bag is small. Therefore, in a bag holder H7 according to the present embodiment, the end portions 1*a* of the arm members 1 are supported at upper ends of the crossing members 3 in a freely rotatable manner, and there are respectively provided a lever 22 fixed at the tip of the end portion la of the arm member 1 and a spring 23 that is engaged against a tip 22*a* of the lever 22 and an upper portion of the crossing member 3. Outwardly directed force is applied to the engaging members 8 in directions shown by arrows K via the arm members 1 by these springs 23, whereby the holding force of the bag can be improved. It should be noted that 24 and 25 denote spring engaging holes.

Figure 15:
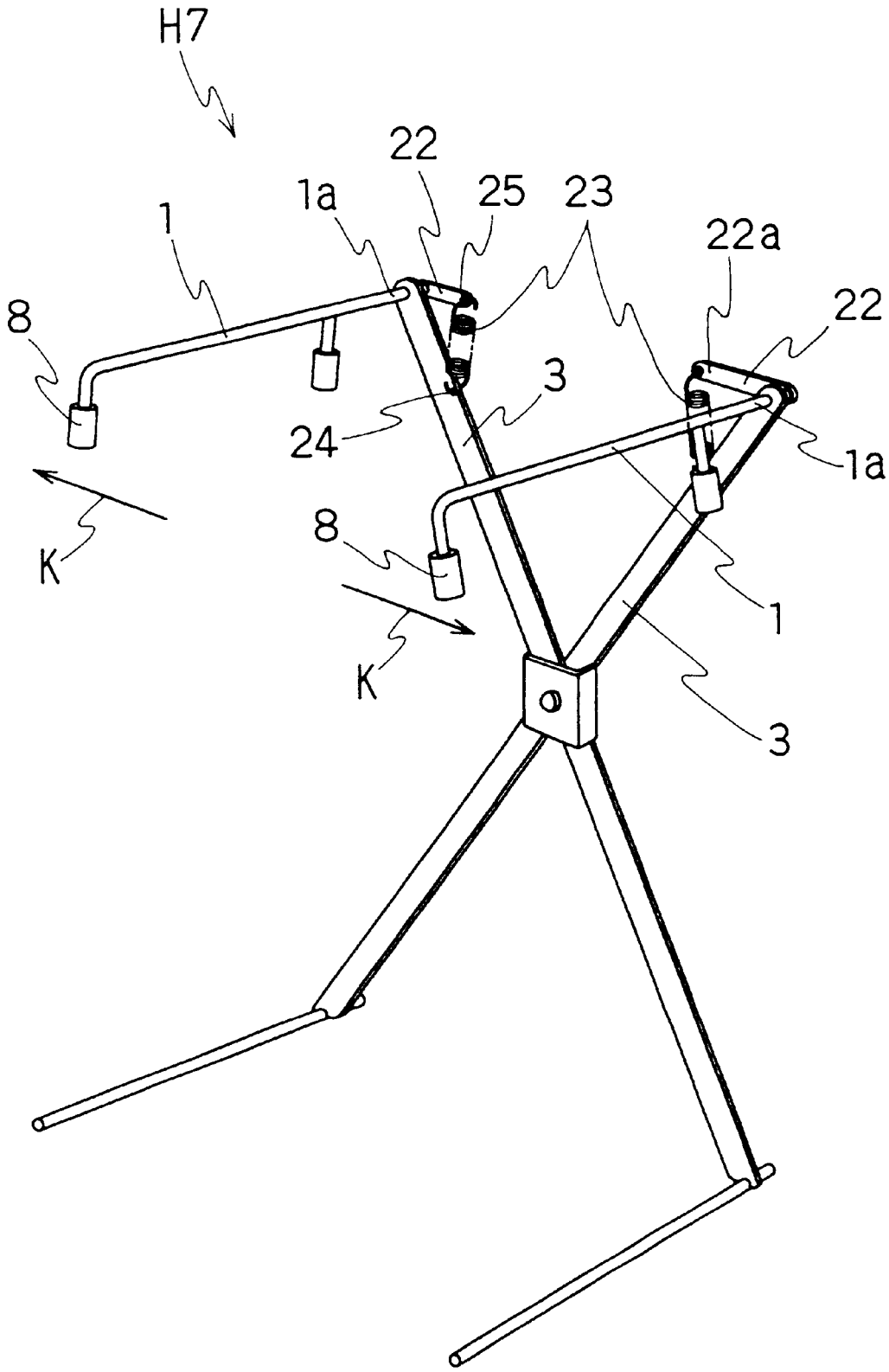
FIG. 15 is a view showing a bag holder in a condition for use according to still another embodiment of the present invention.
Figure 16:
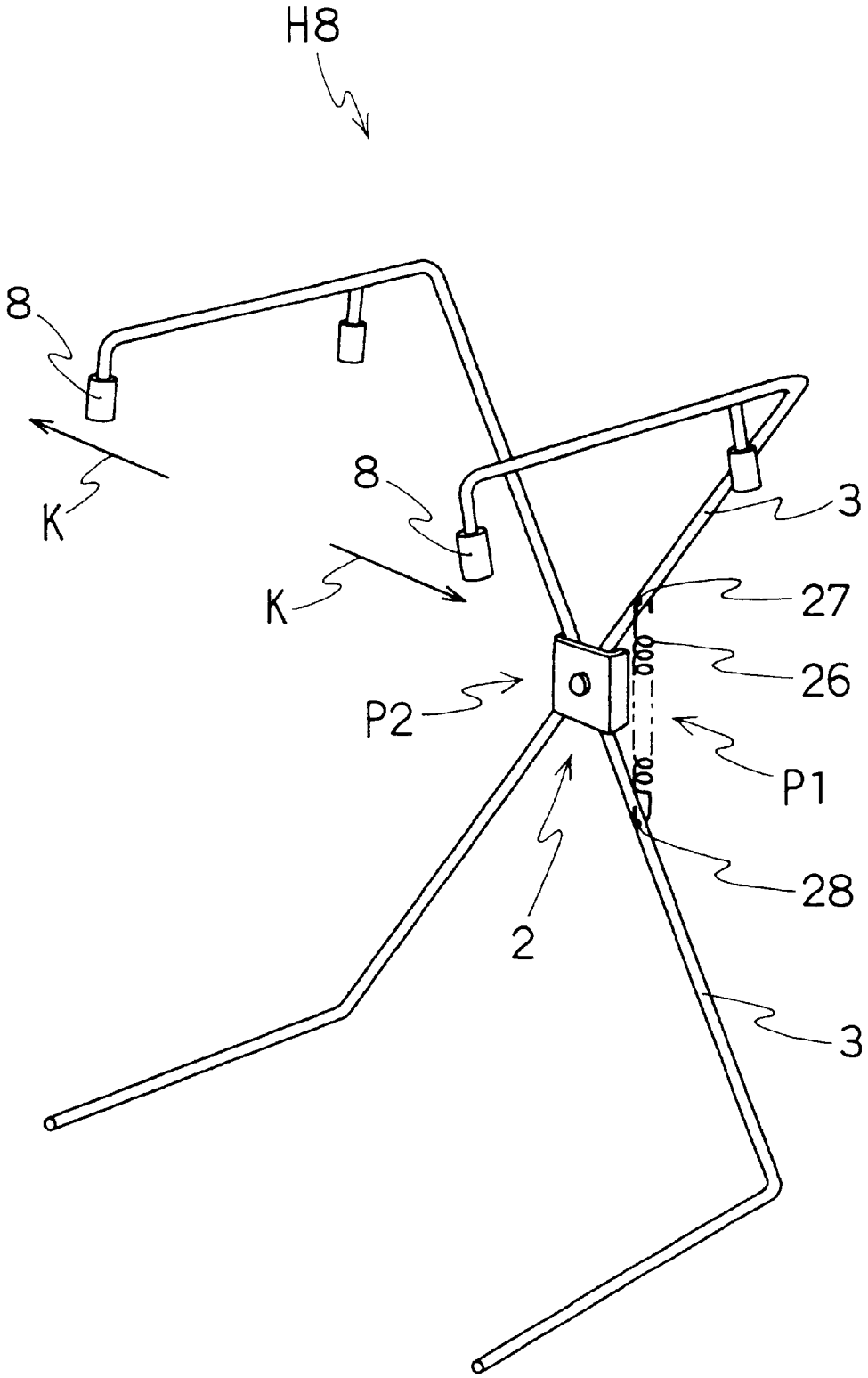
FIG. 16 is a view showing a bag holder in a condition for use according to still another embodiment of the present invention.

Next, still another embodiment of the present invention will be explained. In a bag holder H8 according to this embodiment, when the grounding members do not have rotating members similarly to the embodiment as shown in FIG. 15, a spring 26 is engaged between the pair of crossing members 3 at a lateral position P1 of the fulcrum portion 2, as shown in FIG. 16. By this spring 26, outwardly directed force is applied to the engaging members 8 in directions shown by arrows K. It should be noted that 27 and 28 denote a pair of upper and lower spring engaging holes. While the spring 26 is engaged only at the crossing members 3 at the lateral position P1 of the fulcrum portion 2, the present invention is not limited to this, and a spring might alternatively be engaged also at the crossing members 3 at a lateral position P2 on the other side of the fulcrum portion 2. By engaging springs on both sides of the fulcrum portion, the outwardly directed force of the engaging members can be further increased. It should be noted that in case springs according to this embodiment are to be provided at bag holders as shown, for instance, in FIG. 5 and FIGS. 9 to 12, the pair of upper and lower engaging holes for engaging the springs are provided at three positions.

Figure 17:
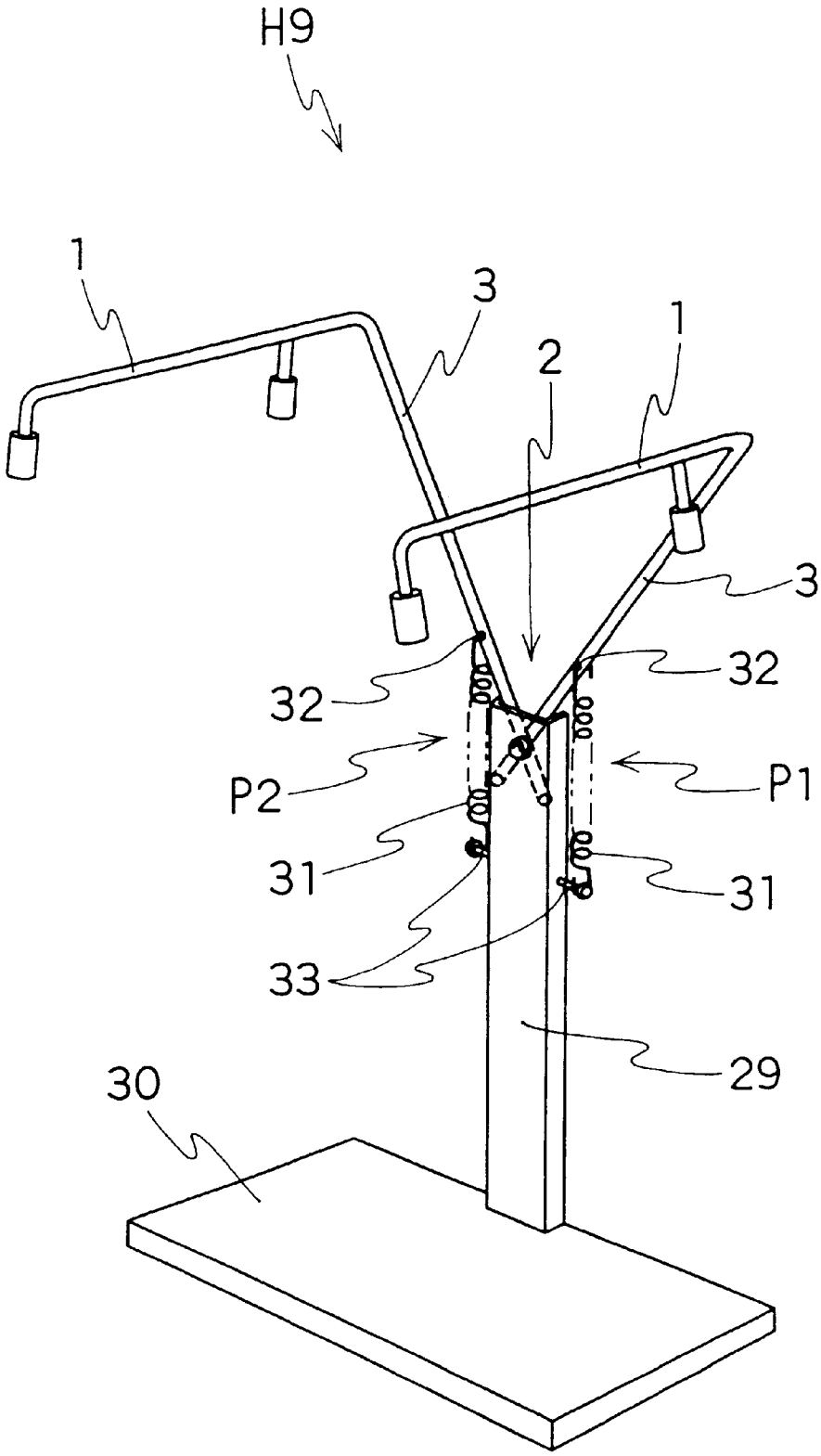
FIG. 17 is a view showing a bag holder in a condition for use according to still another embodiment of the present invention.

Next, the bag holder according to a second aspect of the present invention will be explained. As shown in FIG. 17, the supporting mechanism of the pair of crossing members 3 of the bag holder according to this embodiment is different from those of the bag holders of the preceding embodiments. That is, a bag holder H9 is composed of a pair of arm members 1, a pair of crossing members 3, an erecting member 29 of substantially U-shaped section used for supporting a fulcrum member 2 and concurrently serving as a stopper for preventing expansion of the pair of crossing members to exceed a specified range for usage, a grounding member 30 fixedly attached at a lower end of the erecting member 29 and a pair of springs 31 that are engaged to the crossing members 3 and erecting member 29 at both lateral positions P1, P2 of the fulcrum portion 2. It should be noted that 32 denote spring engaging holes formed at the crossing members 3 and spring engaging pins 33 provided at lateral surfaces of the erecting member 29.

Figure 18:
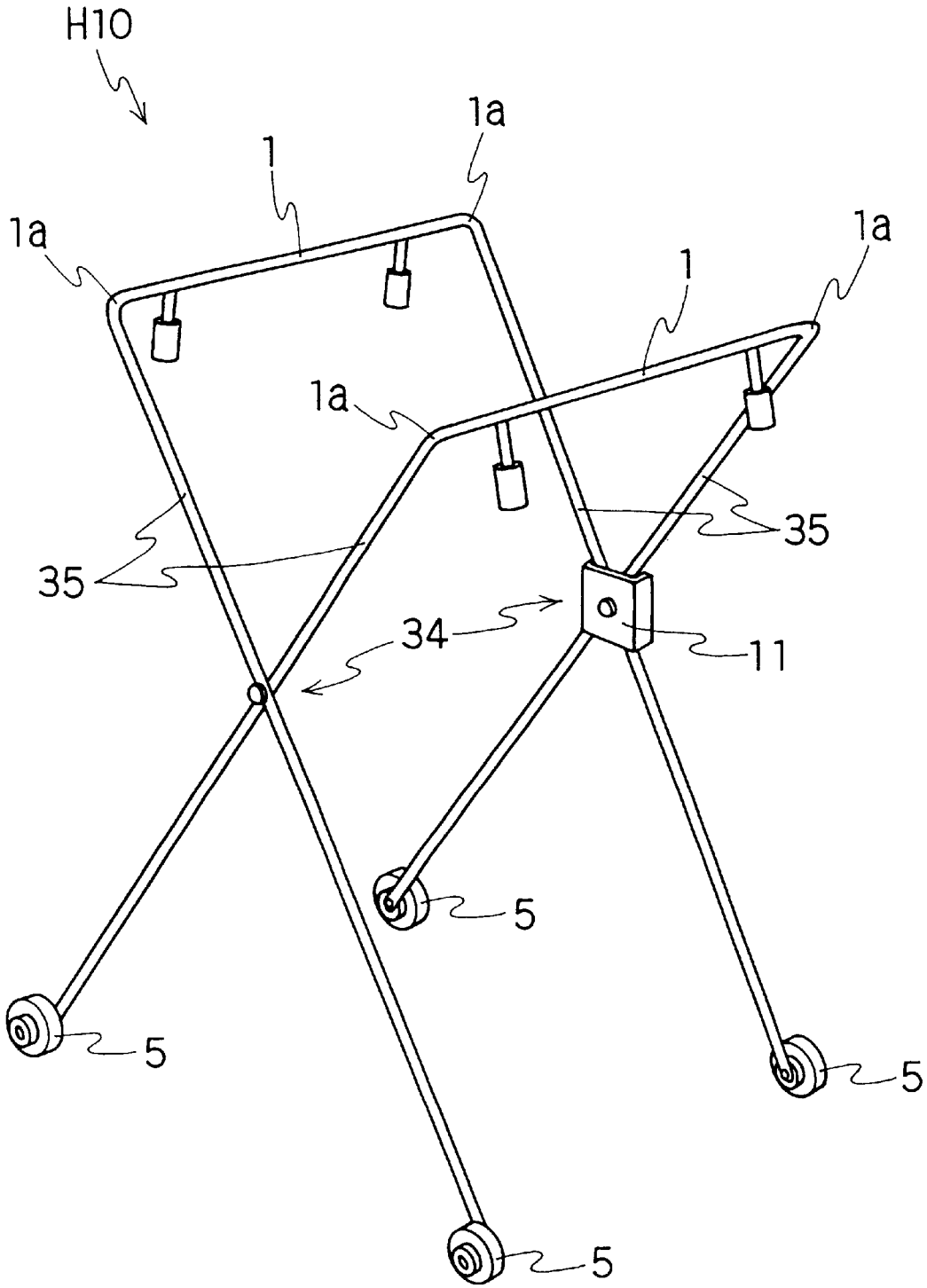
FIG. 18 is a view showing a bag holder in a condition for use according to still another embodiment of the present invention.

The bag holder according to a third aspect of the present invention will now be explained. As shown in FIG. 18, the arrangement of the crossing members 35 of the bag holder according to this embodiment differ from those of the bag holders of the preceding embodiments. That is, a bag holder H10 is composed of a pair of arm members 1, two pairs of crossing members 35 that intersect with each other extending downward from both end portions la of the pair of arm members 1 and enable free opening/closing of the pair of arm members 1 around a pair of fulcrum portions 34, and rotating members such as rollers 5 attached to lower ends of the two pairs of crossing members 35. Since crossing members 35 are respectively formed at both end portions 1*a* of the pair of arm members 1 in this embodiment, the pair of arm members 1 are supported at both sides, whereby the rigidity of the arm members 1 is improved and the bag can be held in a stable manner.

Figure 19:
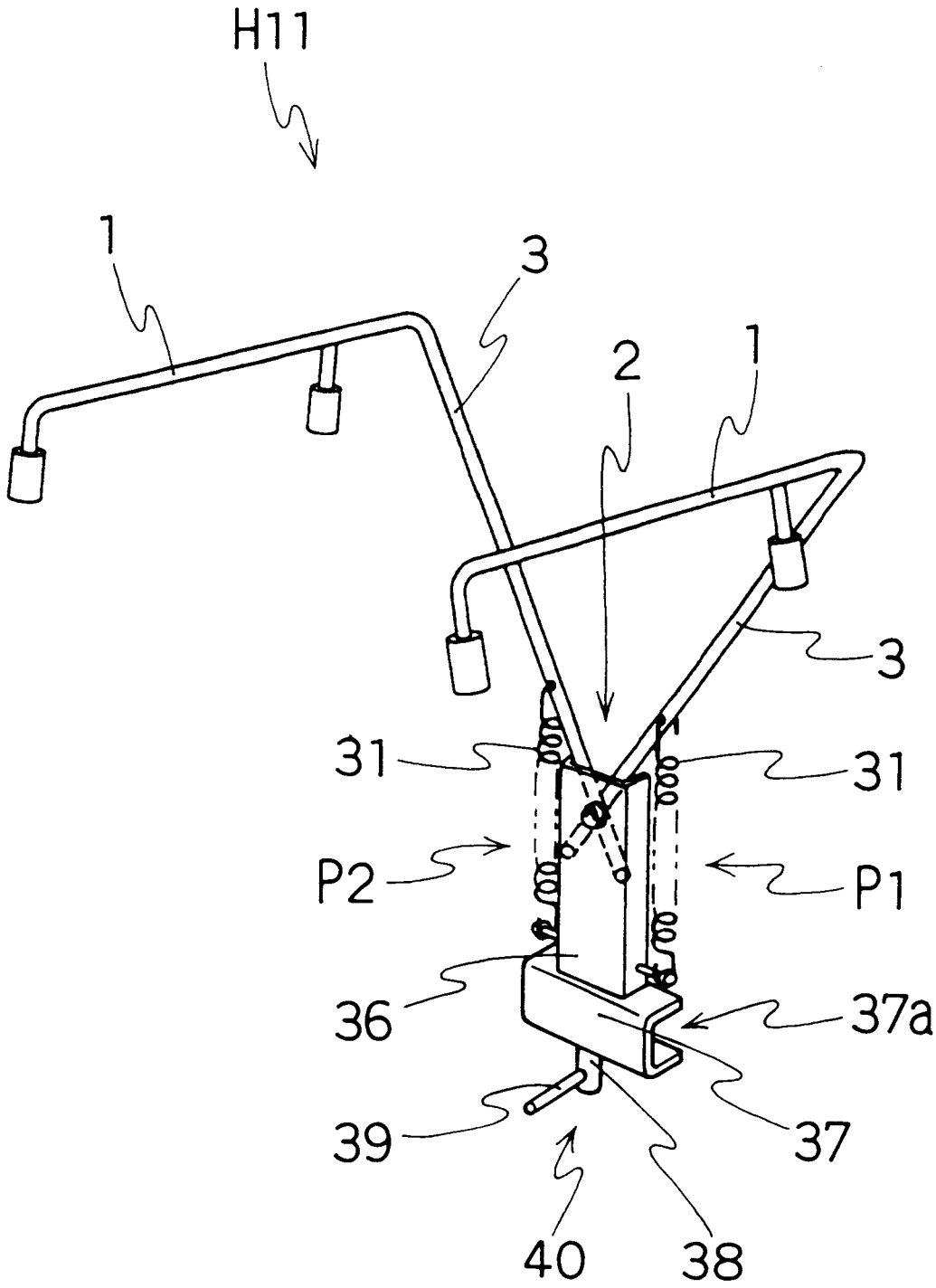
FIG. 19 is a view showing a bag holder in a condition for use according to still another embodiment of the present invention.

The bag holder according to a fourth aspect of the present invention will now be explained. The bag holder according to this embodiment corresponds to the bag holder as shown in FIG. 17 improved as to be of desk type. That is, as shown in FIG. 19, a bag holder H11 comprises a pair of arm members 1, a pair of crossing members 3, an erecting member 36 of substantially U-shaped section used for supporting a fulcrum member 2 and concurrently serving as a stopper for preventing expansion of the pair of crossing members to exceed a specified range for usage, an attaching member 37 of substantially U-shaped section fixedly attached at a lower end of the erecting member 36 in a horizontal direction, a pinching member that is screwed to the attaching member 37, and a pair of springs 31 that are engaged to the crossing members 3 and erecting member 36 at both lateral positions P1, P2 of the fulcrum portion 2. The pinching member might be a rotating member 40 composed, for instance, of a bolt 38 that is screwed into a screw hole of the attaching member 37 and a knob pin 39 for rotating the bolt 38 in both lateral directions. In this embodiment, an opening portion 37*a* of the attaching member 37 is inserted for fixing into an edge portion of a projecting portion of a piece of furniture such as a table or of a wall. When the knob pin 39 is rotated to the right direction, the bolt 38 is raised and the bag holder 11 can be fixed to the edge portion.

As explained so far, the present invention is capable to provide bag holders of favorable convenience since bags can be attached thereto regardless of the size thereof. Alternatively, attaching/detaching of the bag can be easily performed since the bag might simply be hung against or detached from a pair of holding means. Further, since bags can be held in a suspended manner, the external appearance thereof can be made attractive and cleaning of the floor can be easily performed.

What is claimed is:

1. A bag holder for supending a bag thereat with an opening portion of the bag directed upward, comprising a pair of arm members respectively provided with holding means for engaging and holding an interior surface of an opening edge portion of the bag, a single pair of crossing members that intersect with each other being extending downward from end portions of the arm members and making the pair of arm members freely open/close around a fulcrum portion, a pair of grounding members being extended horizontally from lower ends of the pair of crossing members as to oppose the pair of arm members, said pair of grounding members arranged such that the space between said pair of grounding members increases with increase of contents in the bag, so as to increase the space between said pair of arm members, thereby increasing force for holding of the opening edge portion of the bag, and a rotating member attached to at least one grounding member of the pair of grounding members, said rotating member being rotatable solely in a direction so as to facilitate movement of the at least one grounding member to which it is attached in a direction to increase or decrease the space between the pair of grounding members; and wherein said engaging and holding of the bag is by frictional contact at contacting surfaces between the surface of the holding means and the interior surface of the opening edge portion of the bag, and contact pressure is provided by the force due to the increase in space between the pair of arm members in the absence of other force providing means.

2. The bag holder of claim 1, wherein a hanging portion is provided on the pair of arm members.

3. The bag holder of claim 1 wherein the holding means are a pair of holding members directed outwardly from positions on the arm members being remote from each other by a specified distance.

4. The bag holder of claim 3, wherein the holding members are respectively composed of a base portion extending from the arm member and an engaging member provided at an end portion of the base portion.

5. The bag holder of claim 4, wherein the engaging member is a freely rotatable rotating roll.

6. The bag holder of claim 1, wherein the holding means are respectively composed of a base portion extending from the arm member and a linear engaging member provided as to extend from the base portion in a substantially horizontal manner.

7. The bag holder of claim 1, wherein a portion of the arm member between a pair of holding members is composed of an arm base member, an arm front end member being telescopic with respect to the arm base member and a fixing means for positioning the arm front end member.

8. The bag holder of claim 1, wherein the pair of crossing members is respectively composed of a crossing base member, a crossing lower end member being telescopic with respect to the crossing base member, and a fixing means for positioning the crossing lower end member.

9. The bag holder of claim 4, wherein the engaging members are made of silicone rubber.

10. The bag holder of claim 4 wherein means for increasing a friction coefficient between the engaging members and the bag are provided on surfaces of the engaging members.

11. The bag holder of claim 1 wherein a single stopper is provided at the fulcrum portion of the pair of crossing members for preventing expansion of the pair of grounding members exceeding a specified range of usage by acting on both of the crossing members.

* * * * *